United States Patent [19]

Williamson

[11] Patent Number: 4,996,982

[45] Date of Patent: Mar. 5, 1991

[54] EMERGENCY BREATHING APPARATUS WITH HOLSTER RELEASED REGULATOR VALVE

[75] Inventor: Larry H. Williamson, Huntington Beach, Calif.

[73] Assignee: Submersible Systems, Inc., Huntington Beach, Calif.

[21] Appl. No.: 343,005

[22] Filed: Apr. 25, 1989

[51] Int. Cl.[5] ..... A62B 9/02

[52] U.S. Cl. ..... 128/205.24; 128/206.27

[58] Field of Search ..... 128/205.21, 205.22, 128/205.24, 206.27, 207.12, 204.26, 204.18, 201.26, 202.13, 202.19, 202.27

[56] References Cited

U.S. PATENT DOCUMENTS

| | | | |
|---|---|---|---|
| D. 245,121 | 7/1977 | Christianson . | |
| D. 246,671 | 12/1977 | Cerniway . | |
| D. 251,622 | 4/1979 | Garrison et al. . | |
| 2,428,425 | 10/1947 | Levitt . | |
| 2,866,456 | 12/1958 | Lovy et al. . | |
| 2,877,766 | 3/1959 | Moore . | |
| 2,931,057 | 4/1960 | Vilarem . | |
| 3,045,671 | 7/1962 | Updegraff . | |
| 3,776,227 | 12/1973 | Pitesky et al. . | |
| 3,976,063 | 8/1976 | Henneman et al. . | |
| 3,998,226 | 12/1976 | Harris . | |
| 4,019,507 | 4/1977 | Oetjen et al. . | |
| 4,079,735 | 3/1978 | Gaffney | 128/204.18 |
| 4,233,970 | 11/1980 | Kranz | 128/205.24 |
| 4,297,998 | 11/1981 | Christianson et al. | 128/205.24 |
| 4,359,048 | 11/1982 | Aimasi et al. | 128/205.24 |
| 4,365,628 | 12/1982 | Hodel | 128/205.24 |
| 4,438,764 | 3/1984 | Eppolito | 128/205.22 |
| 4,619,255 | 10/1986 | Spinosa et al. | 128/205.24 |
| 4,637,387 | 1/1987 | Hall | 128/205.24 |
| 4,724,833 | 2/1988 | Bartos . | |
| 4,802,472 | 2/1989 | Jung | 128/204.18 |

FOREIGN PATENT DOCUMENTS

| | | | |
|---|---|---|---|
| 95731 | 5/1939 | Sweden | 128/204.18 |
| 2150838 | 7/1985 | United Kingdom | 128/205.21 |

*Primary Examiner*—Eugene H. Eickholt

*Attorney, Agent, or Firm*—Knobbe, Martens, Olson & Bear

[57] ABSTRACT

A short, compact pressure cylinder filled with compressed air under about 3000 psi operating pressure is provided with a scuba type breathing regulator attached to the top thereof. A quick release holster surrounds the cylinder and is easily attached to any flight suit or vest which may be worn by a user. Attached to the holster is a mouthpiece cover to keep the mouth piece and the breathing chamber of the regulator clean and free of debris. The apparatus is easily operated and automatically activated simply by pulling the cylinder from the holster in a single movement. This removal of the cylinder from the holster acts to simultaneously remove the mouthpiece cover and open a supply valve in the regulator, permitting air to be supplied to the regulator valve. The apparatus is sealed at the place of manufacturing and is designed to be virtually maintenance free.

10 Claims, 4 Drawing Sheets

Fig. 4
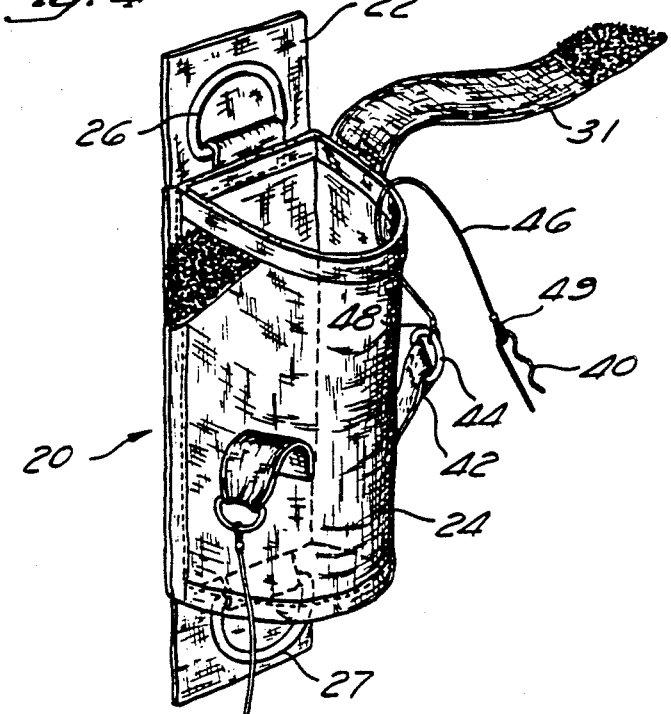
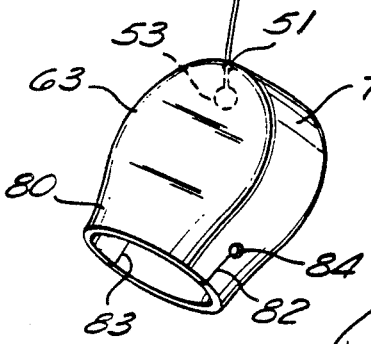
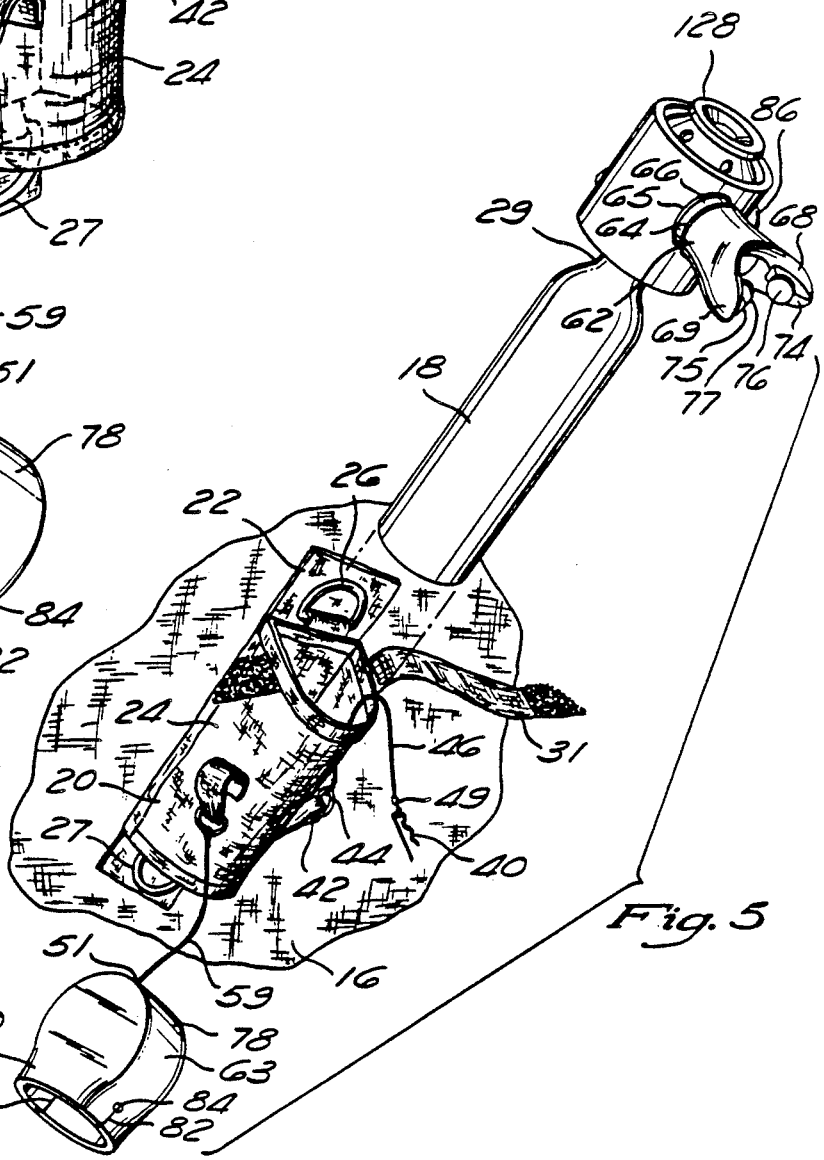
Fig. 5

EMERGENCY BREATHING APPARATUS WITH HOLSTER RELEASED REGULATOR VALVE

FIELD OF THE INVENTION

This invention relates to the field of portable breathing devices for use in emergency situations. More particularly, the invention relates to an improved compact breathing apparatus which is convenient and easy to operate.

BACKGROUND OF THE INVENTION

Portable breathing devices are particularly useful in emergency situations. A typical portable breathing apparatus comprises a compressed air container from which breathing gas, usually compressed air, may be obtained for a short duration of time. It has been found that in many emergency situations a small amount of air, sufficient to last for about two minutes, is all that is necessary for survival. Breathing devices may be used in emergencies that occur in any environment, including, for example, fire, gas leakage, underwater crash and inspection of underwater boat damage.

Emergency breathing devices are particularly important to aircraft pilots and scuba divers. For example, in the event of helicopter crash into water, a portable breathing apparatus can provide sufficient air to enable a user involved in the crash to extract himself from the wreckage and swim to the surface. To provide easy access, the device may be stored inside the pocket of a typical flight suit often worn by military pilots. Thus, a pilot equipped with emergency breathing apparatus may quickly reach into his flight suit pocket, pull out the device, place the mouthpiece to his lips and start breathing.

Similarly, in another exemplary application, a portable breathing device can be of critical importance in the event that a scuba diver runs out of air. The breathing device can provide the extra breath of air necessary for the diver to swim up to the surface.

One such previously available device, of the type shown in U.S. Pat. No. 251,622, has a scuba type breathing regulator at the top and a pressurized cylinder connected thereto. The regulator has a supply valve for turning the device on and off. The supply valve when turned on allows air from within the cylinder to be supplied to the regulator valve. The supply valve is manually turned on and off by a knob. The regulator also has a port to facilitate refilling of the pressurized cylinder. This port is located proximate the supply valve. The port is sealed with a plug. The plug is knurled and has a central groove to facilitate removal. The plug also has a centrally located, spring loaded pin which acts as a pressure indicator. When the cylinder has a sufficient level of compressed air and the supply valve is open the pin will pop up indicating that the cylinder is full. Otherwise the top of the pin will remain flush with the bottom of the groove. A mouthpiece similar to the type used in scuba gear is used to inhale air from within the cylinder as regulated by the breathing regulator.

Although this device has been proven effective in saving lives, it has several significant disadvantages. In an emergency situation, it is desirable to have a breathing device that operates immediately upon inhaling so the user does not waste time fumbling with knobs in a panic situation. As discussed above, in order to use the currently available device, a user must first manually turn on the supply valve prior to using it. In order to avoid the need to take this extra step in an emergency, pilots, for example, in their pre-flight check list, are often required to manually turn on the supply valve prior to taking off. During the lifetime of the device, it is likely that the supply valve will be turned on and off repeatedly by users. This constant movement of the seal within the supply valve increases the likelihood of leakage through the seal. Further during flights and other activities where the supply valve is on, the other seals in the breathing regulator, including the dynamic seals of the regulator valve itself, are subjected to the full pressure of the air in the pressured cylinder. This provides additional opportunity for leakage and consequent failure.

Another disadvantage is that a user may test to see if the device works by allowing a little air to escape through the regulator valve. While doing so, the user has to be careful to limit the outflow, otherwise the device requires refilling. Refilling the apparatus with compressed air is undesirable in view of the time wasted and additional support equipment such as compressors, for example, which are required for the task. Further in order to test for air pressure, it is required that the supply valve be turned on so that the position of the pin on the supply plug can be checked. This type of constant manipulation of the device encourages idle tampering which can lead to malfunctioning of the unit.

Another disadvantage is that the mouthpiece in such a device is exposed and thus prone to accumulate dirt in the mouthpiece requiring a replacement. Additionally an exposed mouthpiece allows foreign objects to accumulate in the breathing chamber.

Prior to using such a device, some form of training is necessary. Without training it may not be readily apparent to a user how to operate such a device. For example, it is necessary for a user to learn how to turn the supply valve on, read the pressure indicator and to test the device prior to use.

These devices, although small, could in some cases get in the way of a person's movement. For example, the smallest currently available breathing device has a cylinder that is 11 inches long and an overall length of 13½ inches including the breathing regulator portion. This device is comfortably accommodated within a pocket of a typical flight suit vest worn by many aircraft pilots. It is desirable to have the apparatus positioned at a tilt when placed in the pocket. A tilted position helps prevent injury to the pilot's head if he slumps over due to the impact of a crash. However, in some cases, especially for a person with a small torso, the apparatus cannot be tilted enough because of its size. Thus, under some circumstances an airman might hit his chin on the device in a crash. Further a smaller device is necessary in order to be practical for use by passengers of an aircraft. Accordingly, a more compact size breathing apparatus is desirable.

SUMMARY OF THE INVENTION

The present invention provides an improved emergency breathing apparatus which is sealed, tamper proof and virtually maintenance free. The improved emergency breathing apparatus is designed to alleviate the existing problems that have arisen in the current equipment. The improved emergency breathing apparatus may advantageously be used in any environment as a safety device, such as fire extinguishers. The preferred embodiment of the present invention comprises a short compact cylinder filled with compressed air at about 3000 psi operating pressure. The apparatus further comprises a multi-purpose holster which surrounds the cylinder. In the preferred embodiment, the apparatus is easily placed in operation by simply pulling the device from its holster in a single movement.

In accordance with a preferred aspect of the present invention, the improved emergency breathing apparatus is virtually tamperproof and requires virtually no training prior to use. The apparatus advantageously comprises a dial gauge which provides a constant direct reading of the pressure in the cylinder. By looking at a dial gauge, much like the gauges commonly found on fire extinguishers, a user can quickly determine whether the cylinder is full. The apparatus further comprises a supply valve for turning on the apparatus which is secured by a safety lock pin. The pin is automatically released when the cylinder is pulled from its holster. Upon being released, the supply valve is automatically turned on. After use, the safety lock pin may be reset, after the cylinder is charged with air, at the place of manufacture. However, because of the design, it will in general not be possible for a user to reset the pin.

In accordance with another preferred aspect of the present invention, the multipurpose holster may be easily and conveniently attached to any vest, flight suit, or the like. The holster comprises fastening means which may be either sewn in place or used in conjunction with quick release clips or snaps.

In accordance with still another aspect of the invention, the apparatus comprises a streamlined, tapered mouthpiece which is very easy to insert quickly in an emergency. Additionally the mouthpiece is sealed by a mouthpiece cover which automatically releases when the cylinder is pulled from the holster. The small, streamlined configuration of the mouthpiece further facilitates quicker release from the mouth cover. The mouthpiece cover protects the breathing chamber of the regulator from accumulating foreign objects and provides protection from oil, dirt, or the like.

In accordance with yet another aspect, the present invention provides a sealed unit which is virtually maintenance free. The apparatus is advantageously sealed at the place of manufacture and designed to last for several years with little or no maintenance. Since the present apparatus is tamperproof, the need to frequently replace parts has been eliminated.

BRIEF DESCRIPTION OF THE DRAWINGS

A preferred embodiment of the present invention is illustrated in and by the following drawings in which like reference numerals indicate like parts and in which:

FIG. 2 illustrates the manner in which the multi-purpose holster may be securely attached within a pocket while a regulator head of the cylinder remains within easy access of a user.

FIG. 3 illustrates the mouthpiece with the cover removed, and the support strap and safety lock pin of the present invention released.

FIG. 4 is a perspective view of a multi-purpose holster of the present invention.

FIG. 5 is a perspective view illustrating the manner in which a cylinder is released from its holster in accordance with the present invention.

DETAILED DESCRIPTION OF THE PREFERRED EMBODIMENT

Figure 1:
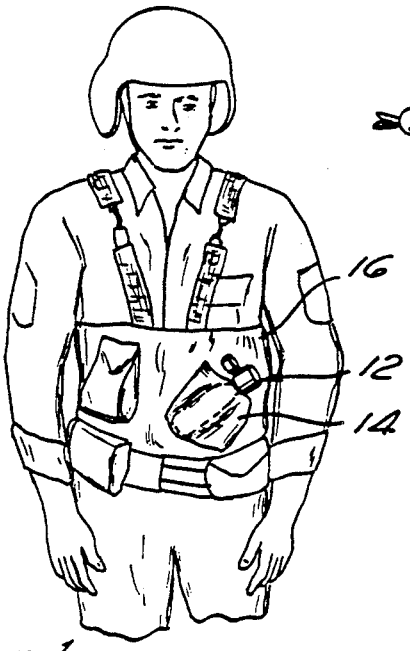
FIG. 1 is a front perspective view illustrating an aircraft pilot carrying an emergency breathing apparatus in accordance with the preferred embodiment of the present invention. The breathing apparatus conveniently fits within the aircraft pilot's flight suit.

FIG. 1 illustrates generally an aircraft pilot carrying an improved and compact emergency breathing apparatus 12 in accordance with the preferred embodiment of the present invention. The breathing apparatus 12 is designed to be tamper proof and virtually maintenance free, and, in emergency situations is easy to operate. The breathing apparatus 12, as shown in phantom, conveniently fits within a pocket 14, of a flight suit 16 which is typically utilized by aircraft pilots. Alternatively, the breathing apparatus may be mounted in any convenient location. For example, if it is to be used in a building, it might be mounted on a wall. Another possible location could be inside a bus or any such means of transportation.

Figure 2:
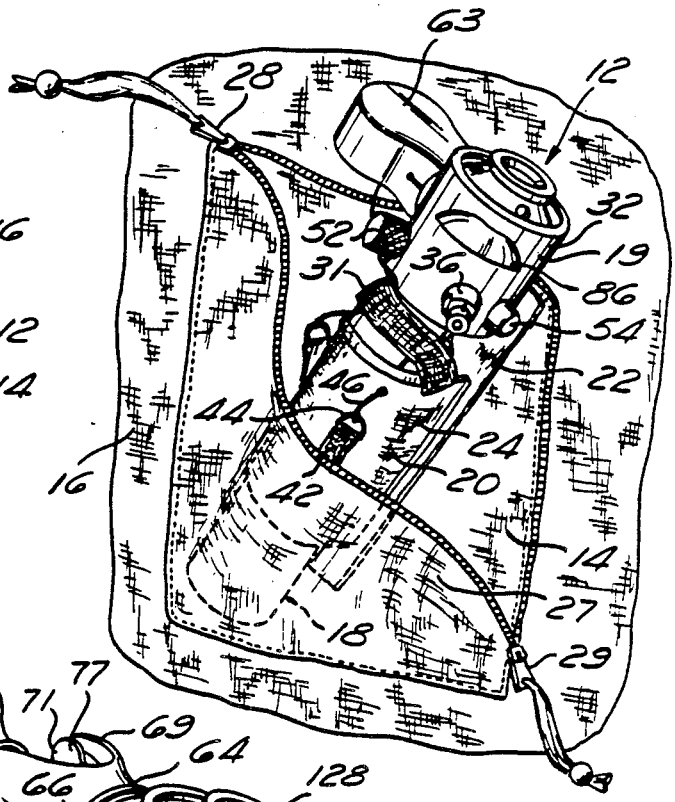
FIG. 2 is a front perspective view of a cylinder surrounded by a multi-purpose holster of the emergency breathing apparatus of the present invention.

Referring now to FIG. 2, the emergency breathing apparatus 12 comprises a cylinder 18 having a regulator head 19 and a multi-purpose holster 20 surrounding the cylinder 18. The cylinder 18, which is of commercially available design, in an exemplary embodiment, may advantageously be about 2⅛ inches in diameter and about 6 inches in length. With a 6 inch long cylinder, the overall length of the apparatus 12 is 8½ inches. Alternatively, the cylinder 18 may have a diameter of about 2 inches and a length of about 8 inches. With an 8 inch long cylinder, the overall length of the apparatus 12 is about 10½ inches. The size of the cylinder 18 determines the amount of compressed air carried, and, the period of breathing time allowed, which, of course, will vary from person to person. For example, if a person were to use the apparatus 12 after exercising, he or she is likely to inhale larger quantities of air and consequently run out of air more rapidly than a user who did not exercise. The cylinder is filled with air compressed at a predetermined pressure. In the preferred embodiment of the present invention, the cylinder 18 is advantageously filled with air compressed at an operating pressure of 3000 psi. The breathing apparatus 12 of the preferred embodiment shown in the drawings, having a size of about 2 inches by 8 inches, provides a user with about two to four minutes of breathing time.

Figure 3:
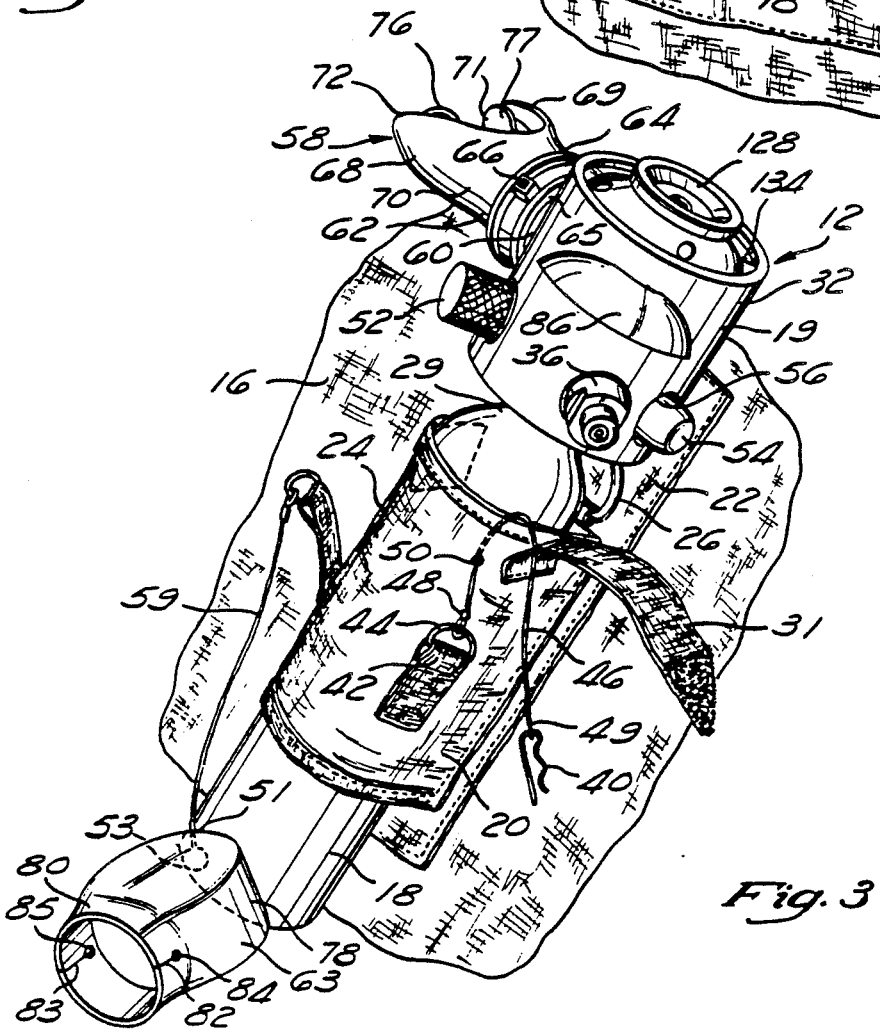
FIG. 3 is a perspective view of a cylinder within a multi-purpose holster of the present invention.

The holster 20 comprises a rectangular strip 22 and a tubular portion 24 suitably attached thereto. The holster is preferably made of a durable material, such as nylon cloth. The tubular portion 24 may be sewn to the strip 22, or attached in any other convenient way, such that the strip 22 extends beyond the tubular portion 24, at either end. The holster 20 may be securely attached within the pocket 14 by sewing the extensions of the strip 22 to the pocket 14. As best shown in FIGS. 3 and 4, the holster 20 also includes two identical D-rings 26, 27 attached to the strip extension 22. The D-rings 26, 27 which may alternatively be commercially available snaps, provide an alternate means by which the holster 20 may be attached to a variety of vests, or belts. It is contemplated that when the apparatus 12 is mounted on a wall, the holster 20 may be formed of a relatively rigid plastic or metal material such that it is suitable for mounting.

The breathing apparatus 12 is preferably attached in a tilted position as shown in phantom in FIG. 1, and, as shown in FIG. 2, may be protected by a pocket flap 27 which is secured by identical zippers 28, 29 which zip around the cylinder 18. The regulator head 19 advantageously remains outside the pocket 14 to allow the user to easily grab the breathing apparatus 12 and pull it free from the pocket 14. The tilted position and the compact size are desirable for an airman with a small torso, because in a crash, the airman might hit his chin on a larger or upright breathing apparatus 12. With the small size of this device, it can be tilted such that he will be very unlikely to hit it.

Referring now to FIGS. 3 and 4, the holster 20 additionally comprises a support strap 31 sewn at the upper end of the tubular portion 24 which is adjacent a neck portion 29 of the cylinder 18. As best seen in FIG. 2, the strap 31 extends over the cylinder neck 29 and under the regulator head 19, releasably fastening at the opposite side of the tubular portion 24. The support strap 31 may be fastened by VELCRO hook and loop fasteners, or in any other suitable manner common in the art, which permits quick release when upward pressure is applied. Advantageously, the cylinder will be released upon application of an upward force in the range of about 10–15 lbs. Accordingly, in the exemplary embodiment, advantageously the area of VELCRO hook and loop fastener engagement of the strap 31 is approximately 1 inch wide by ½ inch long. Alternatively, a well known ball detent connector might be used instead of the VELCRO fastener. The support strap 31 keeps the cylinder from sliding out of the holster 20 when not in use. The regulator head 19 comprises a regulator housing 32 which surrounds a breathing regulator block 34.

Figure 7:
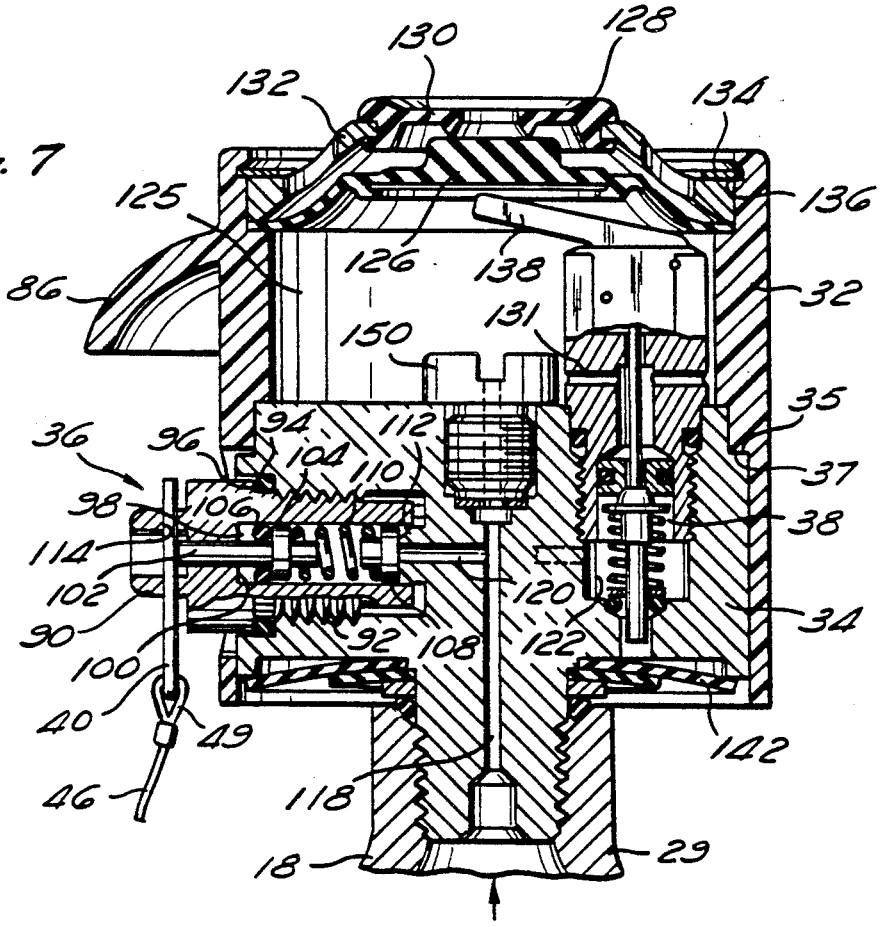
FIG. 7 is a cross sectional view of a regulator head of the emergency breathing apparatus of the present invention.

As best shown in FIG. 7, the breathing regulator block 34 has a shoulder 35 designed to mate with shoulder 37 of the regulator housing 32. Just above shoulder 35, the outer surface of block 34 is knurled to better engage the interior surface of the housing 32. The regulator housing 32 is press fit onto the regulator block 34. The regulator housing is advantageously made from a polycarbonate material, while the regulator block is advantageously made from aluminum. However, any suitable materials may be used.

Referring again to FIG. 3, the regulator head 19 comprises a supply valve 36 for placing the apparatus 12 in it's operational mode. By turning the supply valve 36 on, a user may allow the compressed air from within the cylinder 18 to be supplied to a regulator valve 38 (shown in FIG. 7) in a manner which will be described later. In the preferred embodiment of the present invention, the supply valve 36 is advantageously secured in a closed position by a safety lock pin 40. The safety lock pin 40 is secured to a connector loop 42 sewn to the surface of the tubular portion 24. The connector loop 42 has a circular ring 44, similar to a key ring, connected therethrough. Advantageously a cable 46, extends from the safety lock pin 40 to the circular ring 44. Of course, any other conventional connector may be used. The cable 46 is attached to the safety lock pin 40 and the circular ring 44 by crimped loops 48, 49. The cable 46 extends through an opening 50 within the holster 20. This prevents the cable 46 from hanging loose and being inadvertently snagged and pulled to open the safety lock pin 40. Once the safety lock pin 40 has been released, it may only be inserted back in place after the cylinder 18 is charged with air at the place of manufacture. Thus, by looking at the safety lock pin 40, a user can tell if the apparatus 12 has been tampered with.

The regulator head 19 advantageously has a dial pressure gauge 52, positioned on one side of the supply valve 36. The dial pressure gauge 52 is much like the gauges commonly found on fire extinguishers. The gauge 52 provides a constant direct reading of the pressure within the cylinder 18. By looking at the gauge 52, a user can quickly determine whether the cylinder 18 is fully charged.

A plug 54 is located adjacent the supply valve 36 on the side opposite the dial gauge 52. The plug 54 seals a port 56 which is primarily used to charge the cylinder 18 with air. In the preferred embodiment, the end of the plug 54 facing outwardly is spherical in shape and advantageously has a smooth surface. Such a configuration makes it difficult for a user to undo the plug. The user is therefore discouraged from tampering with it. The plug 54 is tightened very tightly with a torque of about 75 lb. inch at the place of manufacture, making it very difficult to remove.

Figure 6:
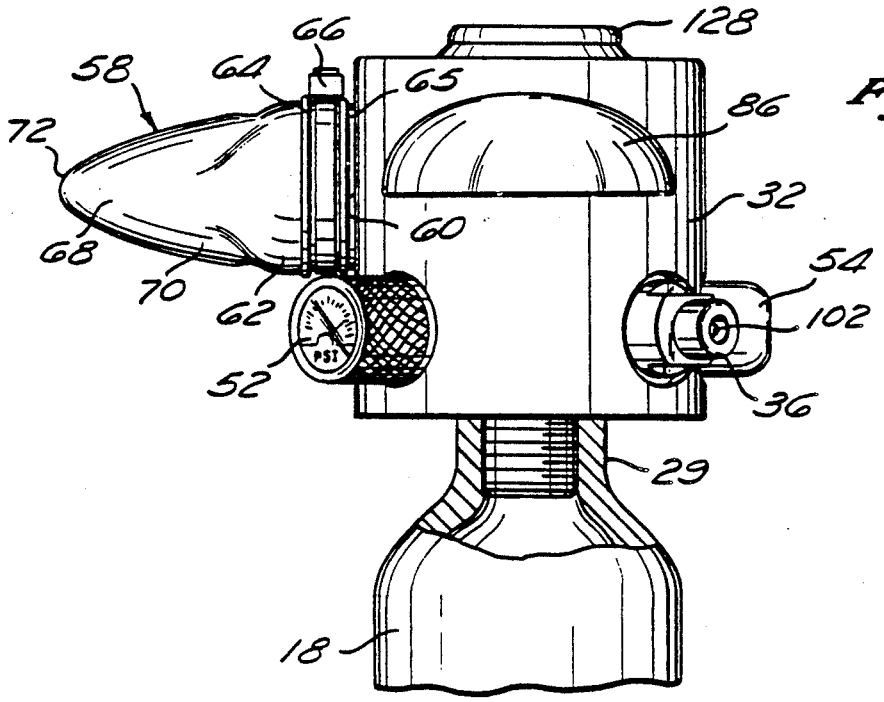
FIG. 6 is a fragmentary, partially cross-sectional view of the cylinder, illustrating a regulator head with a dial gauge and tapered mouthpiece of the present invention.

A user inhales air through a mouthpiece 58 which fits resiliently over a tubular mouthpiece connector 60 extending from the regulator housing 32 and communicating with the interior thereof. The mouthpiece connector 60 extends horizontally outwardly from the regulator head 19. The connection between the mouthpiece 58 and the regulator housing 32 is conventional and much like the connections found in ordinary scuba gear. In accordance with a preferred feature, the mouthpiece 58 is configured to be small and streamlined, so that a user may easily and rapidly insert it into his or her mouth. The mouthpiece 58 is preferably molded as a one-piece unit. The mouthpiece 58 comprises a tubular neck portion 62 which conforms to the exterior surface of the mouthpiece connector 60. As best shown in FIG. 6, two identical spaced apart ribs 64, 65 surround the mouthpiece neck 62. In an exemplary embodiment, between these ribs, a clamp 66, such as a self-locking nylon band clamp common in the art, prevents the mouthpiece 58 from slipping off the connector 60. The mouthpiece 58 has two identical V-shaped extensions 68, 69 curving inward and gradually tapering from a wide proximal end 70 to a narrow distal end 72. The V-shaped extensions 68, 69 surround a central opening 71 in the mouthpiece 58, through which a user may inhale the air from the cylinder 18. The tapered configuration advantageously allows the mouthpiece 58 to be easily inserted and removed from the mouth. Each of the extensions 68 has a wedge-shaped, inwardly projecting rib 74, 75 (as best seen in FIG. 5) terminating in an outwardly flange cap 76, 77. The wedge-shaped ribs 74, 75 are held between the user's teeth, while the caps 76, 77 fit inside the user's teeth.

In the preferred embodiment, the mouthpiece 58 is sealed by a mouthpiece cover 63, when not in use, as shown in FIG. 2. The mouthpiece cover 63 is configured to seal the mouthpiece 58 and provide protection from oil and debris. The mouthpiece cover 63 is secured to the tubular portion 24 of the holster in a manner similar to the safety lock pin 40. A cable 59 is connected to the mouthpiece cover 63 through an aperture 51. A plastic ball 53 (as best seen in phantom, in FIG. 3), having a larger diameter than the aperture 51 holds the cable in place. The mouthpiece cover 63 is advantageously formed from a suitably resilient plastic material such as vinyl. Alternatively, the mouthpiece cover 63 may be a breakaway cellophane cover. The configuration and the resiliency of the material permits the mouthpiece cover 63 to conform over the mouthpiece 58 while sealing it. The mouthpiece cover 63 has a main body 78 which terminates into a tubular neck portion 80. The neck portion 80 advantageously has identical slits 82, 83 at diametrically opposite locations. The slits 82, 83 terminate into stress-relief holes 84, 85. The slits 82, 83 allow the mouthpiece cover 63 to be easily guided onto the mouthpiece 58 as well as easily removed.

The regulator housing 32 advantageously has an integrally formed handle 86. The handle 86, as best seen in FIGS. 3, 6, and 7, advantageously allows the user to firmly grasp the housing 32 in order to pull cylinder 18 out quickly from its holster 20. Although a particular size and shape for the handle is shown, it is contemplated that the handle 86 may be formed in any suitable configuration.

Referring now to FIG. 5, the apparatus 12 is easily placed in operation by simply pulling the cylinder 18 from its holster 20 in a single movement. As the user lifts the housing 32 by the handle 86 (shown in FIGS. 3, 6, and 7) pressure is placed on the connection between the strap 31 and the side of the tubular portion 24, causing the strap 31 to release, and, almost at the same time, the safety lock pin 40 is pulled from the supply valve 36 by the cable 46. The supply valve 36 (as seen in FIG. 2), once released, allows the flow of air from the cylinder 18 to the breathing regulator block 34 (shown in FIG. 7). The manner in which it operates will be described hereinafter. The mouthpiece cover 63 is pulled off the mouthpiece 58 by the cable 59, exposing the mouthpiece 58, so the user may insert it into his or her mouth and start breathing.

Figure 8:
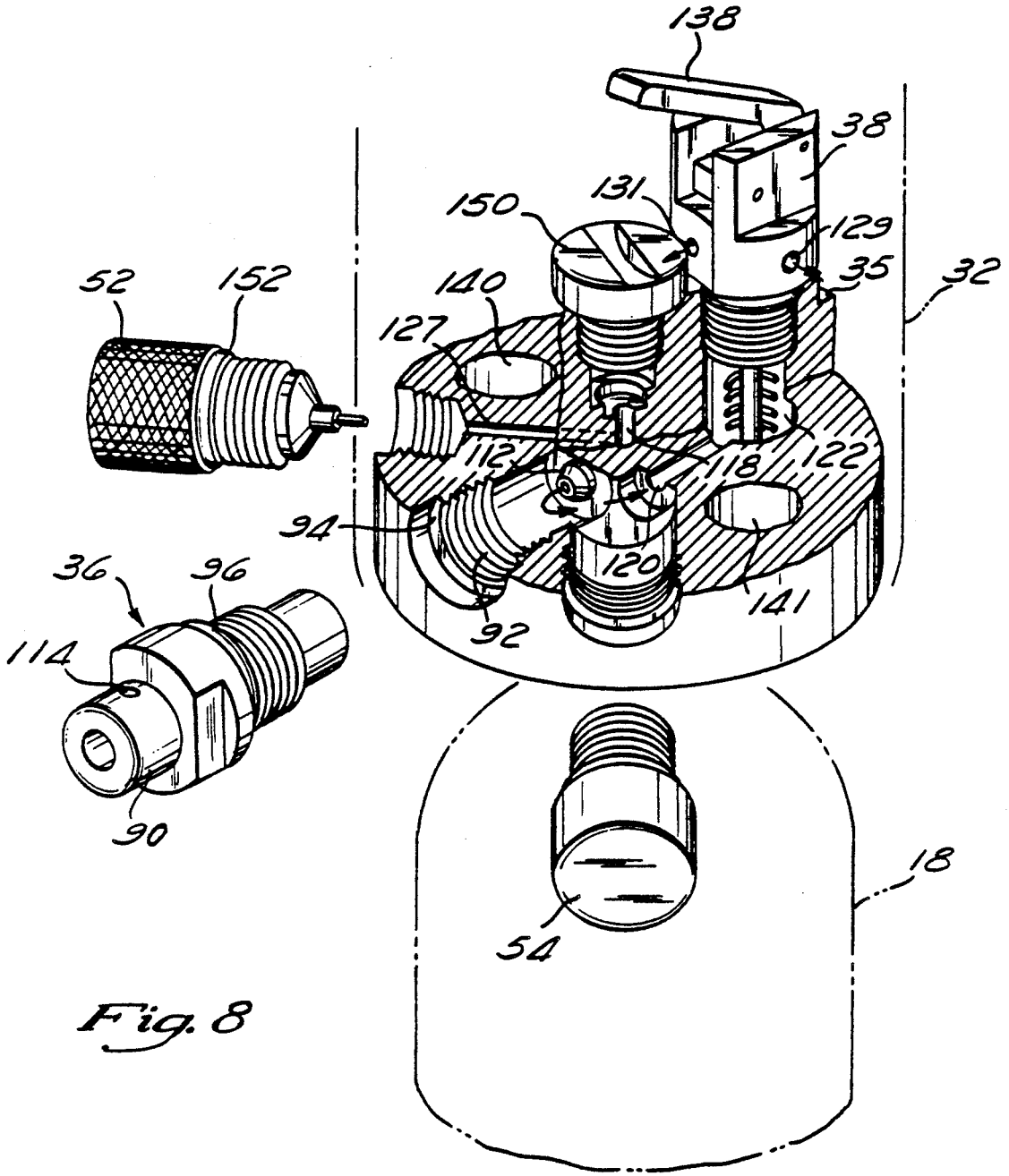
FIG. 8 is a cut away, exploded view illustrating the supply and regulator valves, the dial gauge and the plug within a regulator housing of the present invention.

Referring now to FIGS. 7 and 8, the manner in which the regulator block 32 operates to control the flow of air will be explained. The supply valve 36 comprises an externally threaded body 90 which mates with an internally threaded supply port 92. The externally threaded body 90 clamps an annular o'ring 96, against a shoulder 94 to effectively seal the body 90 to the supply port 92. Alternatively, the body 90 may be configured such that the head portion has a larger diameter (not shown) than the supply port 92. In such a configuration, the head portion abuts the face of the supply port 92, which may be facilitated by flattening the portion of the regulator block 34 surrounding the supply port 92. Such surfaces are called spotface surfaces or counter bored surfaces Extending through the body 90 is a channel 98, which is of smaller diameter toward an outer end and of larger diameter at the inner end. The smaller diameter portion of the channel 98 is divided from the larger diameter portion by a shoulder 100. A metal pin 102 having a shoulder 104 extends through the channel 98. An o'ring seal 106 surrounds the metal pin 102 proximate the shoulder 104. The inner end of the body 90 slidingly supports a poppet 108. Interposed between the metal pin 102 and the poppet 108 is a spring 110. The spring 110 is compressed preferably by about 1/5th of an inch. The poppet 108 sits on a volcano-shaped seat 112. The spring 110 is advantageously 0.250 inches in diameter and 0.5 inches in length, and has a spring rate of 144 lbs/inch. The safety lock pin 40 extends through an aperture 114, seen clearly in FIG. 8, at the outer end of the body 90, and abuts the end of the metal pin 102. With the pin 102 so constrained, the spring 110 is compressed, forcing the poppet 108 against the seat 112, thus keeping the supply valve 36 closed. When the safety lock pin 40 is withdrawn, the pin 102 is allowed to move within the body 90 outwardly, so that the spring 110 stretches to its relaxed state, thereby allowing the air from a central passage 118 within the cylinder 18 to enter a passageway 120 leading through the supply valve 36 to a regulator valve port 122. The air subsequently enters the regulator valve 38, as shown by the arrows in FIG. 8, and then via ports 129, 131 into a breathing chamber 125. The regulator valve 38 regulates the flow of air through the mouthpiece 58 to the user in a manner known to one skilled in the art. The regulator valve 38 is of a type used in previously available devices. When the pin 102 moves outward, the seal 106 engages the shoulder 100 to seal the channel 98.

At the upper end of the regulator housing 32 is a diaphragm 126. The diaphragm 126 is protected by a diaphragm cover 128, of a type commonly available. The diaphragm cover 128 has a flexible central portion 130 surrounded by a rigid portion 132. The diaphragm 126 is held in place by a retainer ring 134 which slides along a groove 136. When a user inhales the diaphragm 126 contacts a regulator lever 138 which opens the regulator valve 38. At the bottom of the regulator block 34 are three outlet ports 140, 141 (only two of which are shown in FIG. 8) which allow the air exhaled by a user to escape. The three ports are covered by a flapper valve 142. The flapper valve 142 is lifted off the ports 140, 141 by the force of the outgoing air. When the user inhales, the flapper valve 142 seals the ports 140, 141 so as to not allow air or water from the outside to enter the breathing chamber 125.

The mouthpiece 58 also connects into the breathing chamber 125 through a passageway (not shown). The central passageway 118 additionally connects to a relief valve 150 which opens into the breathing chamber 125. For example, in the event of fire, if the air in the cylinder 18 becomes overheated and over-pressurized it will be released through the release valve 150. The dial pressure gauge 52, surrounded by an o'ring seal 152 is also connected via a passage 127 to the central passage 118, so that an indication of the air pressure is provided to the user at all times.

Although the invention has been described in terms of the preferred embodiment, other embodiments that are apparent to those of ordinary skill in the art are also within the scope of the invention. Accordingly, the scope of the invention is intended to be defined only by reference to the appended claims.

What is claimed is:

1. An emergency breathing apparatus, comprising:

a cylinder filled with compressed air, said cylinder having a regulator head, said regulator head having a regulator valve for regulating the flow of air from said cylinder to a user;

a holster surrounding said cylinder;

a supply valve, mounted on said regulator head, said supply valve controlling the supply of air from within said cylinder to said regulator valve, and a release mechanism for automatically activating said supply valve when said cylinder is pulled from said holster by a user.

2. An emergency breathing apparatus, as defined in claim 1, wherein said regulator head additionally comprises:

a dial gauge in communication with said cylinder, said dial gauge providing a constant direct reading of the level of compressed air within said cylinder.

3. An emergency breathing apparatus, as defined in claim 1, wherein said apparatus further comprises:

a mouthpiece in communication with said regulator valve, a mouthpiece cover; and a withdrawal mechanism which automatically releases said mouthpiece cover when said cylinder is pulled from said holster.

4. An emergency breathing apparatus, as defined in claim 3, wherein said mouthpiece further comprises:

a mouth-engaging portion having an opening therethrough, and two V-shaped extending portions curved inward toward one another and tapering to a distal end, said extending portions facilitating rapid insertion into a user's mouth.

5. An emergency breathing apparatus, as defined in claim 4, wherein said tapering of said extending portions allows said mouthpiece to be quickly released from said mouthpiece cover.

6. An emergency breathing apparatus, as defined in claim 1, wherein said supply valve comprises:

a metal pin, said metal pin in communication with said release mechanism;

a plug, said plug positioned against a passage into said cylinder;

a spring interposed between said plug and said metal pin, said spring compressed under a predetermined pressure, said predetermined pressure being removed once said release mechanism is released, said spring relaxing and permitting air from within said cylinder to displace said plug and flow through to said regulator valve.

7. An emergency breathing apparatus, comprising:

a holster;

a cylinder filled with compressed air, said cylinder mounted in said holster;

a regulator valve for regulating the flow of air from said cylinder to a user;

a supply valve connected to permit air from within said cylinder to be supplied to said regulator valve; and a safety lock connected to said supply valve, said safety lock being automatically released when said cylinder is pulled from said holster.

8. An emergency breathing apparatus as defined in claim 7, additionally comprising:

a dial gauge in communication with said cylinder, said dial gauge providing a constant direct reading of the level of compressed air within said cylinder.

9. An emergency breathing apparatus as defined in claim 7, additionally comprising:

a mouthpiece in communication with said regulator valve, said mouthpiece sealed by a mouthpiece cover which automatically releases when said cylinder is pulled from said holster.

10. An emergency breathing apparatus, comprising:

a holster surrounding a cylinder, said cylinder having a regulator head for regulating the flow of air from said cylinder to a user, said regulator head having a mouthpiece for providing air to said user and a supply valve for turning on and off said air flow to said user, said holster further comprising:

a mouthpiece cover, said mouthpiece cover for sealing said mouthpiece;

means for turning on said supply valve; and means for quickly releasing said cylinder from said holster, said means automatically activating said means for turning on said supply valve and automatically removing said mouth cover.

* * * * *